United States Patent [19]

Theurer et al.

[11] 4,253,398

[45] Mar. 3, 1981

[54] MOBILE APPARATUS FOR THE CONTINUOUS REPLACEMENT OF TIES

[75] Inventors: Josef Theurer, Vienna; Manfred Brunninger, Linz, both of Austria

[73] Assignee: Franz Plasser Bahnbaumaschinen-Industriegesellschaft m.b.H., Vienna, Austria

[21] Appl. No.: 70,315

[22] Filed: Aug. 27, 1979

[30] Foreign Application Priority Data

Sep. 14, 1978 [AT] Austria ..... 6666/78

[51] Int. Cl.[3] ..... E01B 29/05; E01B 27/11

[52] U.S. Cl. ..... 104/2; 104/6; 104/7 R; 104/137; 414/339; 414/342

[58] Field of Search ..... 104/1 R–7 R, 104/7 A, 7 B, 137; 414/339–342, 345, 347, 348

[56] References Cited

U.S. PATENT DOCUMENTS

| | | | |
|---|---|---|---|
| 4,046,077 | 9/1977 | Theurer et al. | 104/2 |
| 4,152,989 | 5/1979 | Theurer et al. | 104/2 |
| 4,160,418 | 7/1979 | Theurer | 104/2 |
| 4,207,820 | 6/1980 | Cicin-Sain | 104/2 |

FOREIGN PATENT DOCUMENTS

| | | | |
|---|---|---|---|
| 2818514 | 3/1979 | Fed. Rep. of Germany | 104/2 |

*Primary Examiner*—Randolph A. Reese
*Attorney, Agent, or Firm*—Kurt Kelman

[57] ABSTRACT

A track renewal train of a plurality of track-bound freight cars storing ties removed from an old track section and ties to be laid for a new track section comprises a work car whose front frame end is pivotally supported on a last freight car. Elongated conveyors are mounted on the work car for conveying the old ties from a tie removing device and the new ties to a tie laying device. A tie transfer vehicle has front and rear gantry undercarriages, the front gantry undercarriage being movable only on the last freight car and the rear gantry undercarriage being movable only on the work car. The tie transfer vehicle includes two tie gripping devices arranged successively in the working direction of the train for simultaneously receiving the old ties and delivering the new ties while the ties are positioned transversely to the old track section.

8 Claims, 6 Drawing Figures

MOBILE APPARATUS FOR THE CONTINUOUS REPLACEMENT OF TIES

Figures 1, 1A, 2, 2A:
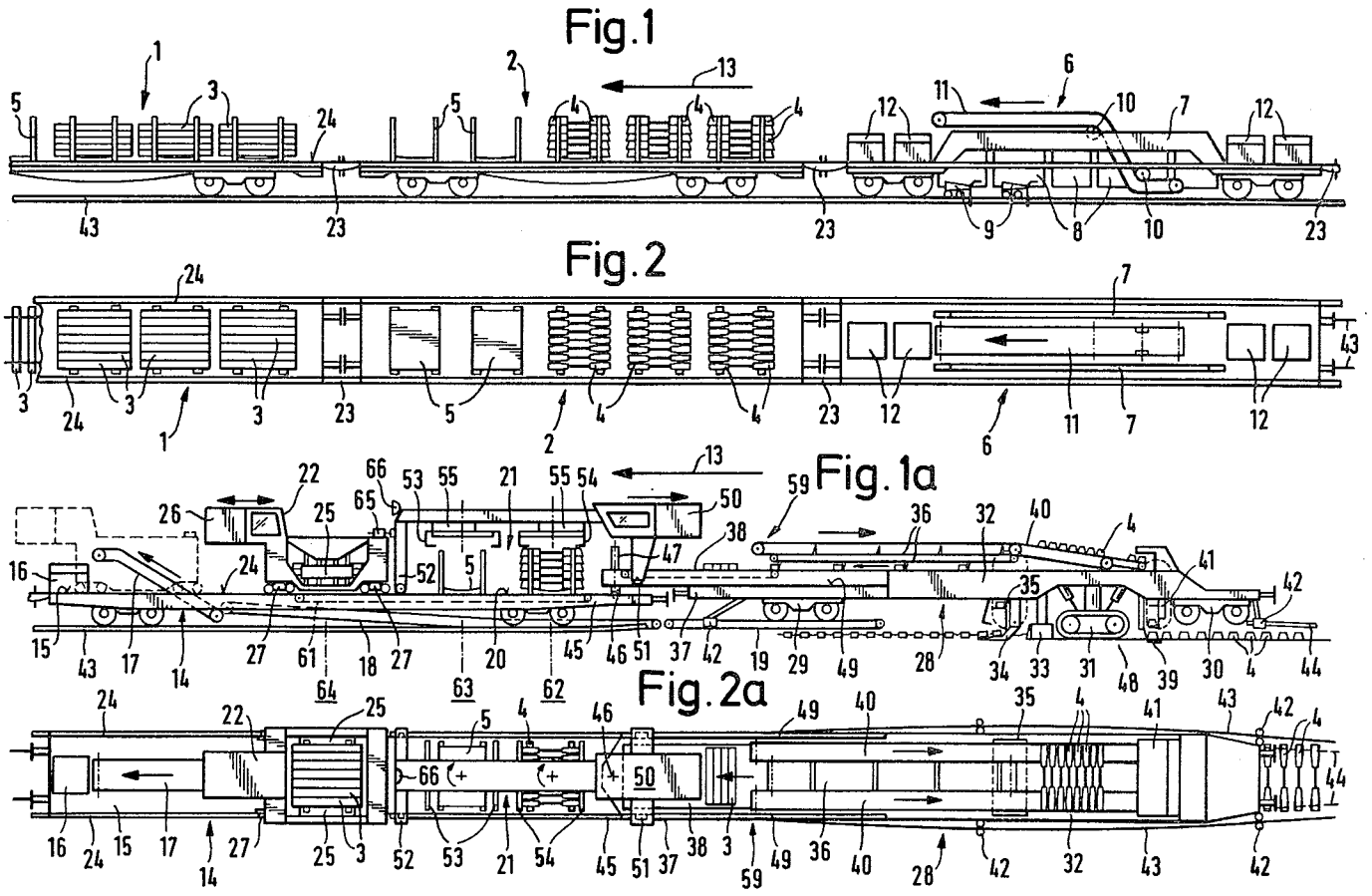

The present invention relates to improvements in a mobile apparatus for the continuous replacement of ties of an old track section resting on a ballast bed by ties of a new track section, which comprises a train of a plurality of track-bound freight cars including a last freight car movable in a working direction over the old track section, old and new ties being stored on selected ones of the freight cars, a traveling gantry crane including means for gripping the ties, the gantry crane being movable on the train to and from respective ones of the freight cars, and a work car coupled to the last freight car, devices being mounted on the work car for removing the ties of the old track section and for laying the ties of the new track section.

U.S. Pat. No. 4,046,077, dated Sept. 6, 1977, discloses a track renewal train of this general type, wherein the work car carries hoist means for receiving and conveying separated sections of the old track section, a track-bound front undercarriage of the car running on the old track section while an off-track, full-track bogie supports the rear end of the work car on the ballast bed. Traveling gantry cranes remove the separated old track sections and deliver the new ties. In such a track renewal train, the track renewal operation may continue uninterrupted while, if desired, selected freight cars loaded with separated old track sections are uncoupled and removed to a storage site, and/or additional freight cars loaded with new ties are coupled to the train. In this manner, it is possible to lay long sections of new track in one continuous operation and dead track times are correspondingly shortened. The arrangement of the work car at the end of the train has the further advantage that all track behind the train is free so that there is no interruption of train traffic in the range of branch tracks, particularly in railroad stations.

A similar work car arrangement in a track renewal train has been disclosed in U.S. Pat. No. 4,152,989, dated May 8, 1979, of the same inventors. Elongated conveyor means are mounted on the work car for conveying the ties of the old track section from the tie removing device and the ties of the new track section to the tie laying device, which devices are mounted on the work car. Turntables are associated with the conveyor means for rotating the ties between positions parallel to the track, in which they are conveyed, and positions transverse thereto, in which they are removed and laid.

It is a primary object of this invention to simplify the tie conveying and transfer mechanisms in a mobile apparatus of the first-indicated type and to enhance not only the efficiency but also the operating safety. It is another object of the invention to provide such a mobile apparatus which is particularly adapted for track renewal operations in curving track sections.

The above and other objects are accomplished according to the present invention with a work car whose front frame end is supported on a pivot on the last freight car for pivoting about a vertical axis. Elongated conveyor means are mounted on the work car for conveying the ties of the old track section from the tie removing device and the ties of the new track section to the tie laying device. A tie transfer vehicle has a front gantry undercarriage movable only on the last freight car and a rear gantry undercarriage movable only on the work car, the tie transfer vehicle including two tie gripping devices arranged successively in the working direction for simultaneously receiving the ties of the old track section and delivering the ties of the new track section while the ties are positioned transversely to the old track section.

In this arrangement, the tie transfer vehicle forms an essential part of the tie conveying system of the track renewal train and assures the rapid and trouble-free conveyance of the ties over the pivotal coupling of the work car to the last freight car of the train in tangent and curved track. The operating movements of the traveling gantry crane and the tie transfer vehicle may be readily attuned to each other so that neither will run empty in conveying new ties to the continuously operating tie laying device and conveying old ties from the continuously operating tie removing device. Even if the traveling gantry crane moves to a relatively remote car of the train, no inerruption will occur in the tie conveyance because a relatively large number of ties can always be stored on the tie transfer vehicle interposed between the elongated conveyor means and the traveling gantry crane.

In addition to these operating advantages which further increase the work speed and thus enhance the economy of the track renewal train, the apparatus of this invention has further important advantages. Since one end of the tie transfer vehicle is supported on the last freight car and its other end on the work car, it does not move from one car to the other during its operation. This makes it unnecessary to provide a transfer ramp between these two cars. Such connecting ramps pose problems in sharp curves where the longitudinal axes of the two cars enclose an angle between each other, making it necessary to provide vehicles moving from one to the other car, for instance gantry cranes, with swivel trucks. Since a pivot supports the front frame end of the work car for pivoting about a vertical axis on the last freight car and the tie transfer vehicle is supported on the cars by front and rear undercarriages, respectively, the transfer car will automatically undergo a continuous pivoting motion in a track curve while it moves between its end positions, being aligned with the longitudinal axis of the last freight car in one end position and with the longitudinal axis of the work car in the other end position. The positioning of the tie transfer vehicle assures that the ties are exactly positioned at their respective transfer points, i.e. transversely to the track in the range of the elongated conveyor means on the work car and parallel to the track in the range of the loading platform on the freight car.

Furthermore, the axle loads of the tie transfer vehicle are distributed over the last freight car and the work car so that their frames need only be strong enough to support half the vehicle load and the pivot supporting the front frame end of the work car also need not be constructed for supporting this not inconsiderable weight.

The above and other objects, advantages and features of the invention will become more apparent from the following detailed description of a now preferred embodiment thereof, taken in conjunction with the accompanying schematic drawing wherein FIG. 1 is a side elevational view of a forward section of the train;

FIG. 1*a* constitutes the continuation of the train of FIG. 1, showing the last freight car and the work car according to the present invention;

FIGS. 2 and 2*a* are corresponding top views of the train illustrated in FIGS. 1 and 1*a;*

Figure 3:
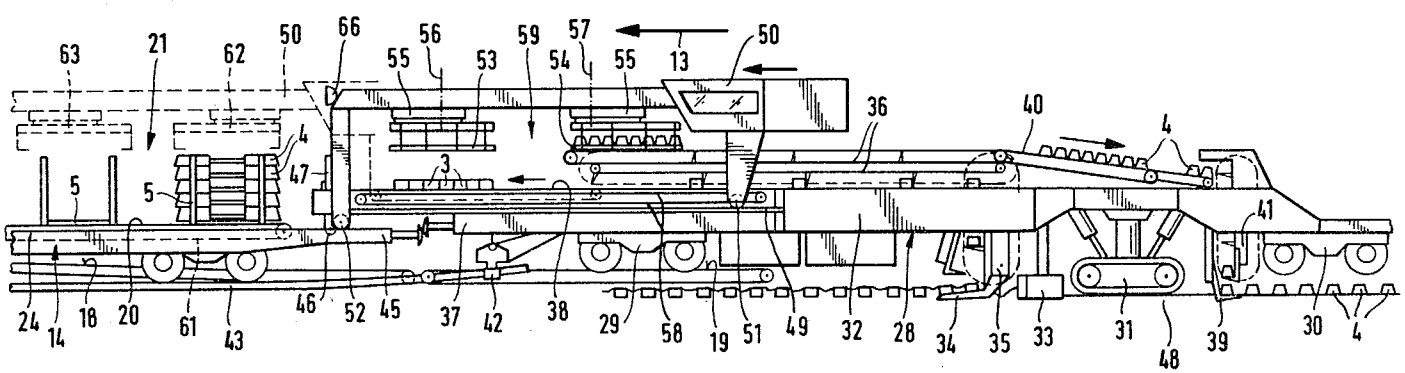
Figure 4:
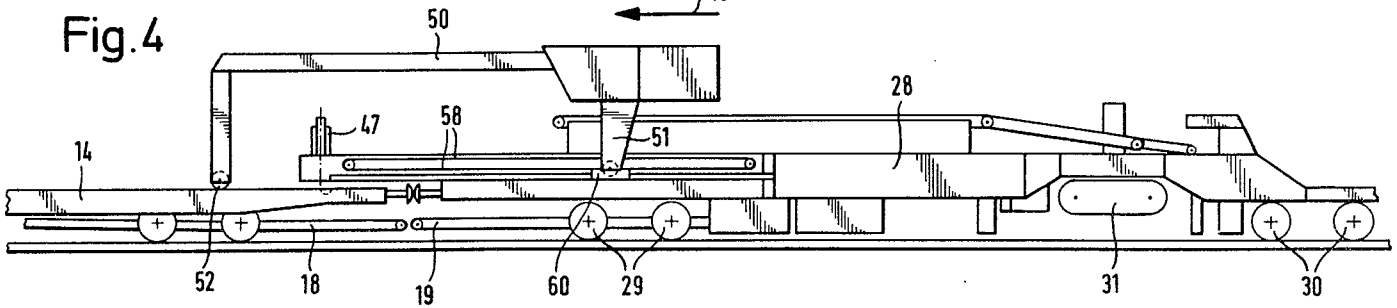

FIG. 3 is an enlarged side elevational view of the work car shown in FIG. 1*a* in operation; and FIG. 4 is a similar view showing the work car track-bound during movement between operating sites, some structural details being omitted for a better understanding.

Referring now to the drawing, there is shown a mobile apparatus for the continuous replacement of ties 3 of an old track section resting on a ballast bed by ties 4 of a new track section. The apparatus comprises a train of a plurality of track-bound freight cars, 1, 2 and 6 including last freight car 14 movable in a working direction indicated by arrow 13 over the old track section. Each of the freight cars is shown as supported on two double-axed swivel trucks and freight cars 1 and 2 are flat cars for storing ties 3 and 4. Traveling gantry crane 22 includes means 25 for gripping the ties, the gantry crane being movable on the train to and from respective ones of the freight cars on continuous track 24 whose rails run along the sides of the cars and over connecting ramps 23 between the cars, all in a well known manner forming no part of this invention.

If the track renewal operation extends over a long stretch of track, additional freight cars will be coupled thereto for storing more ties. It is possible, of course, to uncouple respective cars 1 and 2 after they have been respectively loaded with old ties 3 and emptied of new ties 4, to remove these cars from the working site and to couple another set of cars to the train respectively ready to receive and store additional old ties and to supply new ties. All of this may be done without interrupting the track renewal operation. The ties are stored and conveyed by the gantry crane on pallets 5 in superposed layers and so stacked that they extend parallel to the old track. Flat cars 1 and 2 are shown to accommodate five pallets.

Freight car 6 is equipped with mechanisms 9 for removing rail fastening elements, such as tie bolts or spikes. Car 6 has two laterally extending girders 7 projecting above its platform and several operator's cabs 8 are suspended from the girders, a respective mechanism 9 being associated with each cab. Endless conveyor 11 supported by rollers 10 is arranged on car 6 centrally between girders 7, a portion of the conveyor extending above the girders and another conveyor portion extending therebelow. The other conveyor portion constitutes the input end of the conveyor and receives rail fastening elements removed from the old track section by mechanism 9 while the upper conveyor portion constitutes the output end of the conveyor delivering the removed rail fastening elements to containers 12 which are stored on the platform of car 6.

Last freight car 14 is coupled to car 6. In a manner forming no part of the invention, container 16 is stored on front loading platform 15 of car 14 and receives tie plates removed from the old track section and conveyed to the container by three successive, centrally arranged elongated conveyors 17, 18 and 19 mounted on car 14.

A first tie transfer station 21 is situated on rear loading platform 20 of flat car 14 for the intermediate storage of two stacks of ties arranged successively in the working direction. In the operating phase illustrated in FIGS. 1*a* and 2*a*, one pallet 5 is empty and ready for receiving a stack of old ties 3 while succeeding pallet 5 carries a stack of new ties 4. Traveling gantry crane 22 including means for gripping the ties is movable on the train between transfer station 21 and respective ones of freight cars 1 and 2, as described hereinabove. In the illustrated operating stage, gantry crane 22 is positioned on car 14 adjacent transfer station 21 and tie gripping means 25 is a hoist capable of lifting and carrying a respective pallet 5 loaded with ties so that the ties may be transported along track 24 in lifted position. The gantry crane is self-propelled, drive 26 being connected to hoist 25 for operating the same as well as to wheels 27 of the gantry crane for moving the crane along the track.

According to the present invention, pivot 46 supports front frame end 37 of work car 28 for pivoting about a vertical axis in a substantially horizontal plane on last freight car 14. The front frame end of the work car is supported on the old track section by vertically and laterally adjustably mounted track-bound undercarriage 29 and the rear end of work car 28 carries a retractable track-bound undercarriage 30 and a retractable track-laying undercarriage 31 frontwards of undercarriage 30. These two undercarriages are retracted alternatively, the track-laying undercarriage supporting the rear end of work car 28 on the ballast bed during track renewal operations while undercarriage 30 is retracted (see FIG. 1*a*) and undercarriage 31 being retracted during movement of the work car from work site to work site (see FIG. 4) while undercarriage 30 supports the rear end of the work car on the track. Mounted on work car 28 are device 34 for removing ties 3 of the old track section and device 39 for laying ties 4 of the new track section, vertically adjustable ballast planing device 33 being mounted on frame 32 of the work car between devices 34 and 39 to plane the ballast bed after the old ties have been removed and before the new ties are laid, the tracks of undercarriage 31 further smoothing and compacting the planed ballast and providing firm supports for the new ties laid by device 39. These arrangements on the work car are known and form no part of this invention.

As is also known, tie removing device 34 comprises vertical conveyor 35 moving the removed ties above the platform of work car frame 32 and tie laying device 39 comprises vertical conveyor 41 moving new ties 4 to the device. Elongated conveyor means are mounted on work car 28 for conveying ties 3 from conveyor 35 of tie removing device 34 and ties 4 to conveyor 41 of tie laying device 39, the elongated conveyor means including first elongated conveyor comprising part 36 receiving old ties 3 from conveyor 35 in succession and moving the ties in their transverse position to part 38 mounted on front frame end 32 of the work car. The elongated conveyor means further includes second elongated conveyor 40 moving in the opposite direction to that of conveyor parts 36 and 38, the second conveyor delivering a succesion of new ties 4 in transverse position to vertical conveyor 41 of the track laying device.

In the illustrated embodiment, first conveyor 36, 38 extends close to pivot 46 and other conveyor 40 extends towards the pivot and ends a distance from the pivot corresponding to about half the axle distance or wheel base of gantry undercarriages 51 and 52 of tie transfer vehicle 50 of this invention, other conveyor 40 partially overlapping first conveyor 36, 38. In this manner, the tie transfer takes place substantially at the pivot connecting the work car to the last freight car, thus shortening the path of movement of the tie transfer vehicle as well as the total length of the track renewal train.

As shown in FIG. 2*a*, part 36 of first conveyor 36, 38 is an endless conveyor including entrainment elements arranged thereon for engaging longitudinal sides of ties 3 of the old track section, the first conveyor being arranged about centrally on work car 28. Other conveyor 40 consists of two conveyor bands transversely spaced from each other and running on respective sides of the centrally arranged endless conveyor of conveyor part 36, the two conveyor bands supporting respective ones of the ends of ties 4 of the new track section being conveyed thereby. The tie entrainment elements may be teeth or ledges on the endless conveyor and this conveying arrangement for the old and new ties has the advantage of considerably reducing the height of the elongated tie conveyor means, thus enabling tie transfer vehicle 50 to pass thereover without difficulty when its tie gripping means has been suitably lifted. This construction also is very simple so that is is readily accesible for maintenance.

Pivot 46 may be a two-part bearing socket whose upper part 47 may be arranged vertically adjustably on front frame end 37 of work car 28. In the operating position illustrated in FIGS. 1*a*, 2*a* and 3, work car 28 is supported in front by lowered bearing socket part 47 and in the rear by track-laying bogie 31 engaging ballast 48. When the work car is moved over track from operating site to operating site (see FIG. 4, the work car is simply coupled to last freight car 14, undercarriage 31 is retracted and track-bound undercarriage 30 is lowered into engagement with the track so that work car 28 moves on undercarriages 29 and 30. Bearing socket part 47 is moved into its upper position so that front frame end 37 of the work car and rear frame end 45 of the last freight car are freely movable in relation to each other so that they may readily follow the track in curves.

The present invention provides tie transfer vehicle 50 having front gantry undercarriage 52 and rear gantry undercarriage 51 which define an axle distance or wheel base therebetween. The front gantry undercarriage is movable only on last freight car 14 and the rear gantry undercarriage is movable only on work car 28. Tie transfer vehicle 50 includes two tie gripping devices 53 and 54 arranged successively in the working direction indicated by arrow 13 for simultaneously receiving ties 3 of the old track section and delivering ties 4 of the new track section while the ties are positioned transversely to the old track section. In the illustrated embodiment, last freight car 14 carries track 24 for the movement of front gantry undercarriage 52 therealong and front frame end 37 of work car 28 carries track 49 for movement of rear gantry undercarriage 51 therealong, the tracks extending for a distance of at least the axle distance between the qantry undercarriages from pivot 46. As shown in the preferred embodiment, tracks 24 and 49 are at different levels, track 24 on freight car 14 being arranged at a lower level than track 49 on front frame end 37 of work car 28, track 49 overlapping track 24 in the range of the pivot. Track 24 is the final track section of a track for traveling gantry crane 22, which extends over freight cars 14, 6, 2 and 1.

Since higher track 49 overlaps lower track 24 in the range of pivot 46 in the working direction, the pivot may be arranged closer to last freight car 14, thus shortening not only the overall length of the train but also the path of movement of the tie transfer vehicle. The two-level track arrangement takes into account that tie gripping hoists 53, 54 require only a minor vertical movement in one end position of tie transfer vehicle 50 to deposit one layer of new ties 4 on conveyor 40 and receive one layer of old ties 3 from conveyor part 38 while a considerable vertical movement of the tie gripping hoists is required in the other end position of vehicle 50 to receive pallets of new ties from gantry crane 22 or deliver pallets of old ties to the gantry crane. In this manner, the time required for lifting and lowering the hoists is reduced to a minimum. Making the final section of track 24 available for movement of vehicle 50 provides a particularly simple construction and does not interfere with the movements of gantry crane 22 and tie transfer vehicle 50 on this common track because the working rhythm is such that only the crane or the vehicle are at the overlapping track section at any one time. Furthermore, if a tie transfer vehicle according to this invention is built into an existing track renewal train of this general type, no additional track need be provided for the front gantry undercarriage of the vehicle since such trains already have a track for a tie transporting traveling gantry crane.

Tie transfer vehicle 50 is movable between loading platform 20 of last freight car 14 adjacent pivot 46 and elongated conveyor means 36, 38, 40, i.e. between tie transfer stations 21 and 59, for transferring ties 3, 4 positioning transversely to the old track. Rotating devices 55 are associated with tie gripping devices 53 and 54 for moving the ties gripped thereby from a position transverse to the old track section to a position parallel thereto. Turning hoists 53 and 54 by turntables 55 makes it possible to reposition ties 3 and 4 by 90° at tie transfer station 21 so that they are changed from a position in which they extend parallel to the old track section to one in which they extend transversely thereto, and vice versa. This makes it posible to change the transverse tie position at station 21 so that the ties will extend parallel to the old track section on the gantry crane, enabling the ties to be stored in this position on freight cars 1 and 2. In view of the length of the ties, particularly concrete ties, and the limited portal of gantry crane 22, which moves over the stored ties, it is advantageous and may be essential to store the ties on the freight cars parallel to the track, thus making it possible for the gantry crane to pass.

Tie transfer vehicle 50 has a drive for moving the vehicle between transfer stations 21 and 59, stationary endless chain drive 58 being illustrated in FIG. 3 for this purpose. The movement path of the vehicle and its dimension as well as the arrangement of tie gripping hoists 53 and 54 thereon are such that hoist 53 will be above first conveyor part 36 for ties 3 and hoist 54 will be above other conveyor 40 for ties 4 when vehicle 50 is at transfer station 59.

The operation of the above-described and illustrated apparatus will be summarized hereinbelow.

During movement between working sites (see FIG. 4), tie transfer vehicle 50 is moved into an intermediate position between transfer stations 21 and 59, and is held against movement in the working direction indicated by arrow 13 by clamping shoes 60 or like securing means. Front gantry undercarriage 52 remains free to move to enable vehicle 50 to move relatively to work car 28 and last freight car 14 in track curves.

When the train arrives at a track renewal site, work car 28 is brought into its operating position. As shown in FIG. 1*a*, one pallet 5 on tie transfer vehicle 50 is empty and ready to receive old ties 3 while another pallet 5 loaded with new ties 4 is ready on the vehicle. Clamping shoes 60 are disengaged and tie transfer vehicle 50 is moved from the intermediate position shown in FIG. 4 to tie transfer position 21 (see FIGS. 1*a* and 2*a*). Tie gripping hoist 54 is then lowered, one layer of ties 4 is gripped and turned 90° by operation of turntable 55 so that the ties are moved from a position wherein they extend parallel to the old track section to a position wherein they extend transversely thereto. Drive 58 is then operated to move the vehicle from transfer station 21 to transfer station 59, as shown in FIG. 3, while the layer of ties 4 is lifted by hoist 54. Meanwhile, the removal device 34 has begun operations to remove ties 3 of the old track section which were previously loosened from rails 43 of the old track section on car 6. At transfer station 59, tie gripping hoists 53 and 54 are lowered, hoist 54 depositing the layer of ties 4 gripped thereby on conveyor 40 which moves the ties to tie laying device 39. Simultaneously, lowered tie gripping hoist 53 receives a layer of ties 3 which, meanwhile, have been removed from the old track section by tie removing device 34 and conveyed by vertical conveyor 35 and elongated conveyor parts 36 and 38 underneath hoist 53. After hoist 54 has released ties 4 and hoist 53 has gripped ties 3, the tie gripping hoists are raised again and tie transfer vehicle is returned to front tie transfer station 21. There, rotating devices 55 are operated to turn the hoists gripping the ties 90° so that the ties are moved into a position parallel to the old track section and, at the same time, hoists 53 and 54 are lowered, hoist 53 depositing the layer of ties 3 it grips on pallet 5 while hoist 54 grips a layer of ties 4 from adjacent pallet 5. The hoists are now raised again and the above operating cycle is repeated until tie transfer vehicle 50 has brought the last layer of ties 4 to rear transfer station 59.

After the last layer of ties 4 has been removed from rear pallet 5, elongated conveyor 61 mounted on last freight car 14 is operated to move empty rear pallet 5 from rear position 62 to front position 63 and simultaneously to move front pallet 5 loaded with ties 3 into forward position 64. Prior to this, traveling gantry crane 22 has been operated to bring a pallet 5 loaded with ties 4 from a selected freight car 14 and follows tie transfer vehicle 50 moving to transfer station 59 so that the gantry crane will position the pallet with ties 4 above rear loading platform 20 in position 62. During its movement, loaded pallet 5 is suspended on crane 22 above the loaded pallet in forward position 64. This position being empty, hoist 25 on the gantry crane will be lowered to deposit the loaded pallet on the loading platform. Gantry crane 22 then is moved forward to position 64 and hoist 25 grips the pallet loaded with ties 3, whereupon the gantry crane is moved to a selected freight car 1 where ties 3 are stored. Meanwhile, tie transfer vehicle 50 has followed traveling gantry crane 22 to transfer station 21 and the above-described operating cycles can now be repeated.

To facilitate the tandem movements of gantry crane 22 and tie transfer vehicle 50, the gantry crane may carry abutment means 65 and the tie transfer vehicle may be equipped with signalling arrangement 66 to signal to the operator of gantry crane 22 "go" and "stop" cycles. We have disclosed a signalling system useful for this purpose in our copending U.S. patent application Ser. No. 037,099, filed May 8, 1979.

While the present invention has been described in conjunction with a now preferred embodiment, many modifications and variations in individual structures may occur to those skilled in the art, particularly in relation to the number, series arrangement and structure of the train cars, the arrangements for removing, conveying and laying the ties, and the specific structures of the traveling gantry crane and the tie transfer vehicle. Also, it is not necessary to use pallets for transporting the ties and they may simply be stacked.

What is claimed is:

1. A mobile apparatus for the continuous replacement of ties of an old track section resting on a ballast bed by ties of a new track section, which comprises a train of a plurality of track-bound freight cars including a last freight car movable in a working direction over the old track section, old and new ties being stored on selected ones of the freight cars, a traveling gantry crane including means for gripping the ties, the gantry crane being movable on the train to and from respective ones of the freight cars, a work car having a front frame end, a pivot supporting the front frame end of the work car for pivoting about a vertical axis on the last freight car, devices mounted on the work car for removing the ties of the old track section and for laying the ties of the new track section, elongated conveyor means mounted on the work car for conveying the ties of the old track section from the tie removing device and the ties of the new track section to the tie laying device, and a tie transfer vehicle having front and rear gantry undercarriages, the undercarriages defining an axle distance therebetween, the front gantry undercarriage of the tie transfer vehicle being movable only on the last freight car and the rear gantry undercarriage of the tie transfer vehicle being movable only on the work car, the tie transfer vehicle including two tie gripping devices arranged successively in the working direction for simultaneously receiving the ties of the old track section and delivering the ties of the new track section while the ties are positioned transversely to the old track section.

2. The mobile apparatus of claim 1, wherein the last freight car carries a track for the movement of the front gantry undercarriage therealong and the front frame end of the work car carries a track for the movement of the rear gantry undercarriage therealong, the tracks extending for a distance of at least the axle distance from the pivot.

3. The mobile apparatus of claim 2, wherein the tracks are arranged on the last freight car and the front frame end at different levels.

4. The mobile apparatus of claim 3, wherein the track on the freight car is arranged at a lower level than the track on the front frame end of the work car, the latter track overlapping the former track in the range of the pivot.

5. The mobile apparatus of claim 1 or 2, wherein the elongated conveyor means includes a first conveyor extending close to the pivot and arranged for conveying the ties of the old track section from the tie removing device, and another conveyor arranged for conveying the ties of the new track section and extending towards the pivot and ending a distance from the pivot corresponding to about half the axle distance between the front and rear gantry undercarriages, the other conveyor partially overlapping the first conveyor.

6. The mobile apparatus of claim 1, further comprising a track for the traveling gantry crane, the track extending over the freight cars and including a final track section on the last freight car for the movement of the front gantry undercarriage of the tie transfer vehicle therealong.

7. The mobile apparatus of claim 1 or 6, wherein the last freight car has a loading platform adjacent the pivot, the traveling gantry crane being movable between the loading platform and the freight cars selected for storing the old and new ties, the gripping means being arranged on the gantry crane for gripping the ties in a position substantially parallel to the old track section, the tie transfer vehicle being movable between the loading platform and the elongated conveyor means for transferring the ties positioned transversely to the old track section, and further comprising a rotating device associated with each tie gripping device for moving the ties gripped thereby from a position transverse to the old track section to a position parallel thereto.

8. The mobile apparatus of claim 1, wherein the elongated conveyor means includes a first conveyor arranged for conveying the ties of the old track section from the tie removing device and another conveyor arranged for conveying the ties of the new track section to the tie laying device, the first conveyor being an endless conveyor including entrainment elements arranged thereon for engaging the longitudinal sides of the ties of the old track section and the endless conveyor being arranged about centrally on the work car, and the other conveyor consisting of two conveyor bands transversely spaced from each other and running on respective sides of the centrally arranged endless conveyor, the two conveyor bands supporting respective ones of the ends of the ties of the new track section being conveyed thereby.

* * * * *